US006231043B1

(12) United States Patent
James, III et al.

(10) Patent No.: US 6,231,043 B1
(45) Date of Patent: May 15, 2001

(54) RETRACTABLE EXIT TRAY FOR IMAGING APPARATUS

(75) Inventors: Edmund Hulin James, III; Thomas Eugene Pangburn; David Christopher Tattershall; David Howard White, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/363,451

(22) Filed: Jul. 29, 1999

(51) Int. Cl.[7] ..... B65H 31/00
(52) U.S. Cl. ..... 271/209; 271/188; 271/161
(58) Field of Search ..... 271/188, 209, 271/161

(56) References Cited

U.S. PATENT DOCUMENTS

| | | | | |
|---|---|---|---|---|
| 2,796,259 | | 6/1957 | Fawcett . | |
| 2,937,021 | | 5/1960 | Keil . | |
| 3,749,398 | | 7/1973 | Fujita et al. . | |
| 4,728,963 | | 3/1988 | Rasmussen et al. . | |
| 5,299,875 | | 4/1994 | Hock et al. . | |
| 5,324,020 | | 6/1994 | Rasmussen et al. . | |
| 5,404,805 | * | 4/1995 | Fujimoto et al. | 101/118 |
| 5,419,548 | | 5/1995 | Ueda et al. . | |
| 5,451,044 | | 9/1995 | Nakayama . | |
| 5,516,091 | | 5/1996 | Nakayama . | |
| 5,580,041 | | 12/1996 | Nakayama . | |
| 5,603,493 | | 2/1997 | Kelly . | |
| 5,648,807 | | 7/1997 | Saito et al. . | |
| 5,686,950 | | 11/1997 | Hirakue . | |
| 5,975,521 | * | 11/1999 | Ono et al. | 271/188 |

* cited by examiner

*Primary Examiner*—Donald Walsh
*Assistant Examiner*—Jonathan R. Miller
(74) *Attorney, Agent, or Firm*—Jacqueline M. Daspit; Ronald K. Aust

(57) ABSTRACT

The invention is directed to a media tray for an imaging apparatus for receiving a sheet of media. The media tray includes a base having a first side region and a second side region, a first sheet support member, a second sheet support member, a first mechanism, a second mechanism, and a force applying mechanism. The first and second mechanisms pivotally couple the first and second sheet support members to the side regions of the base, respectively. The force applying mechanism applies a force on the first and second sheet support members such that each of the first and second sheet support members diverge upwardly and outwardly from the base. The force applying mechanism includes a first cam member or first spring mechanism positioned between the first sheet support member and the base and a second cam member or second spring mechanism positioned between the second sheet support member and the base.

21 Claims, 10 Drawing Sheets

RETRACTABLE EXIT TRAY FOR IMAGING APPARATUS

TECHNICAL FIELD OF INVENTION

The present invention relates to a media exit or output tray for an imaging apparatus, and more particularly, to a retractable media exit or output tray for an ink jet printer.

BACKGROUND OF THE INVENTION

Most ink jet printers include some method of providing for a tray or bin to hold media once the media exits the printer. Early trays consisted of a flat tray that held the media in a flat fashion. The printing speed of early printers was slow enough so as to allow for the ink on a printed sheet of media to dry before the next sheet of media was positioned on top of the previous sheet.

As printing speeds increased, the ink on a printed sheet of media was unable to dry before the next sheet of media was positioned on top of the previous sheet. Hence, the ink would often smudge due to the contact with the next sheet of media. Some attempts have been made to address this problem by adjusting the drying properties of the ink. Other attempts have focused on methods of processing the media. For example, several printers have elaborate devices that tilt and kick the media onto staging platforms that are later actuated to allow the media to drop onto the surface of the tray. Other attempts have been directed to mechanisms which actively or passively hold the media such that the media's transverse cross section is concave.

Although the aforementioned attempts have addressed ink smudging problems with various degrees of success, they typically require complex, non-compact mechanisms or special media. Furthermore, the complexity of the mechanisms lend themselves to a higher probability of breakdown and higher costs. Also, the size of the mechanisms consume valuable desk space and are cumbersome to use. Thus, a need exists for a media exit tray with a simple design that addresses the ink drying problem, and is retractable within the printer to reduce the space required for the printer.

SUMMARY OF THE INVENTION

The invention is directed to a media tray for an imaging apparatus for receiving a sheet of media. The media tray includes a base having a first side region and a second side region, a first sheet support member, a second sheet support member, a first mechanism, a second mechanism, and a force applying mechanism. The first and second mechanisms pivotally couple the first and second sheet support members to the side regions of the base, respectively. The force applying mechanism applies a force on the first and second sheet support members such that each of the first and second sheet support members diverge upwardly and outwardly from the base. The force applying mechanism can be either a cam or spring mechanism.

In one preferred embodiment, a media tray for receiving a sheet of media transported thereto from an imaging apparatus includes a base and a media support assembly. The media support assembly is moveably coupled to the base and includes at least one cam member that engages an inclined region of the base. The at least one cam member forces an outer portion of said media support assembly to move upwardly relative to the base when the media support assembly is moved in a first direction relative to the base. The base is slideably coupled to the imaging apparatus.

The media support assembly includes a base extension having a first side region and a second side region positioned above the base. The base extension is slideably coupled to the base. The media support assembly also includes a first and second sheet support member, each of which is pivotally coupled to the first and second side regions of the base extension, respectively. Each of the first and second sheet support members includes a downwardly extending cam member having a cam surface for engaging the inclined region of the base. As the base extension is slid outward from the base, the first and second cam surfaces engage the inclined region of the base to force each of the first and second sheet support members to pivot upward and away from the base.

Other features and advantages of the invention may be determined from the drawings and the detailed description of the invention that follows. Corresponding reference characters indicate corresponding elements throughout the several figures.

DETAILED DESCRIPTION OF PREFERRED EMBODIMENTS

Figure 1:
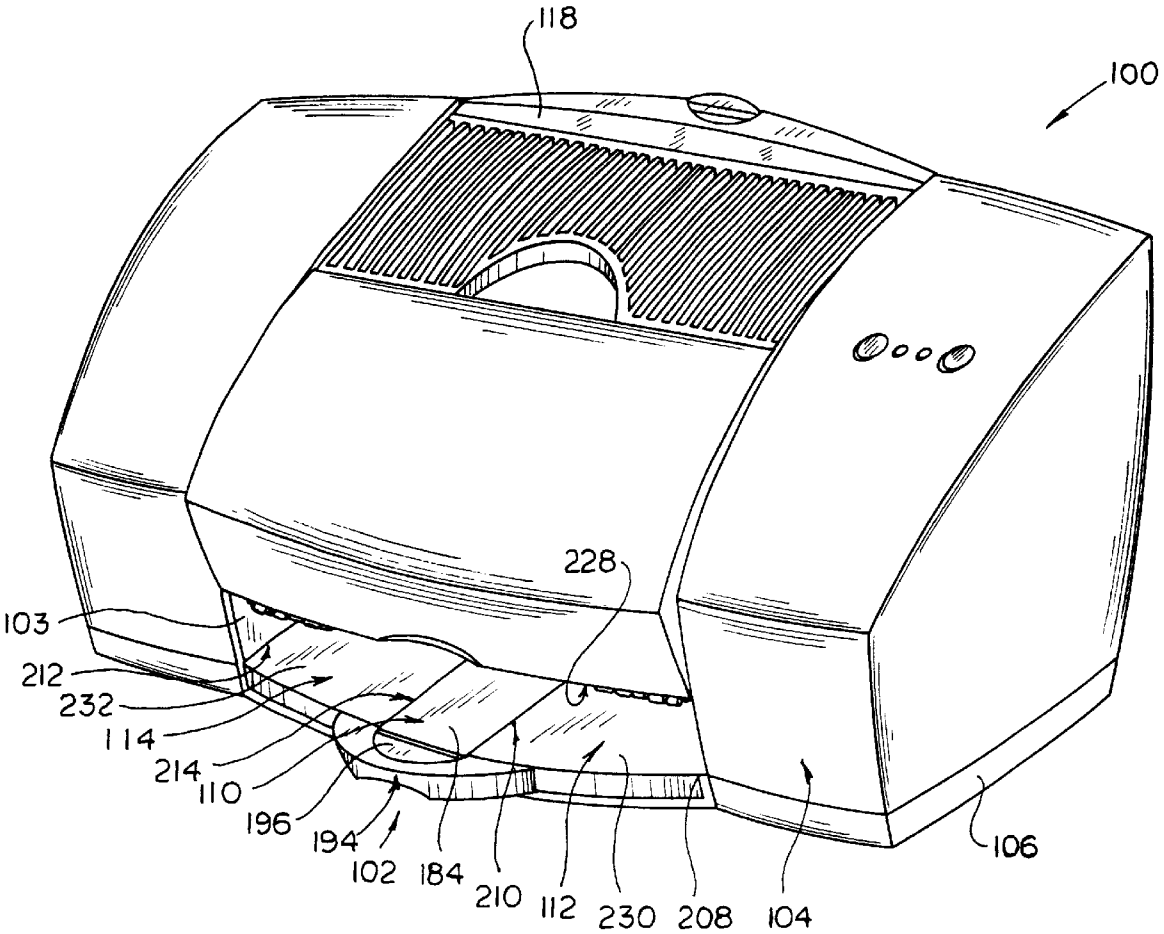
FIG. 1 is a perspective view of an ink jet printer incorporating a retractable exit tray of the present invention shown in the retracted position.
Figure 2:
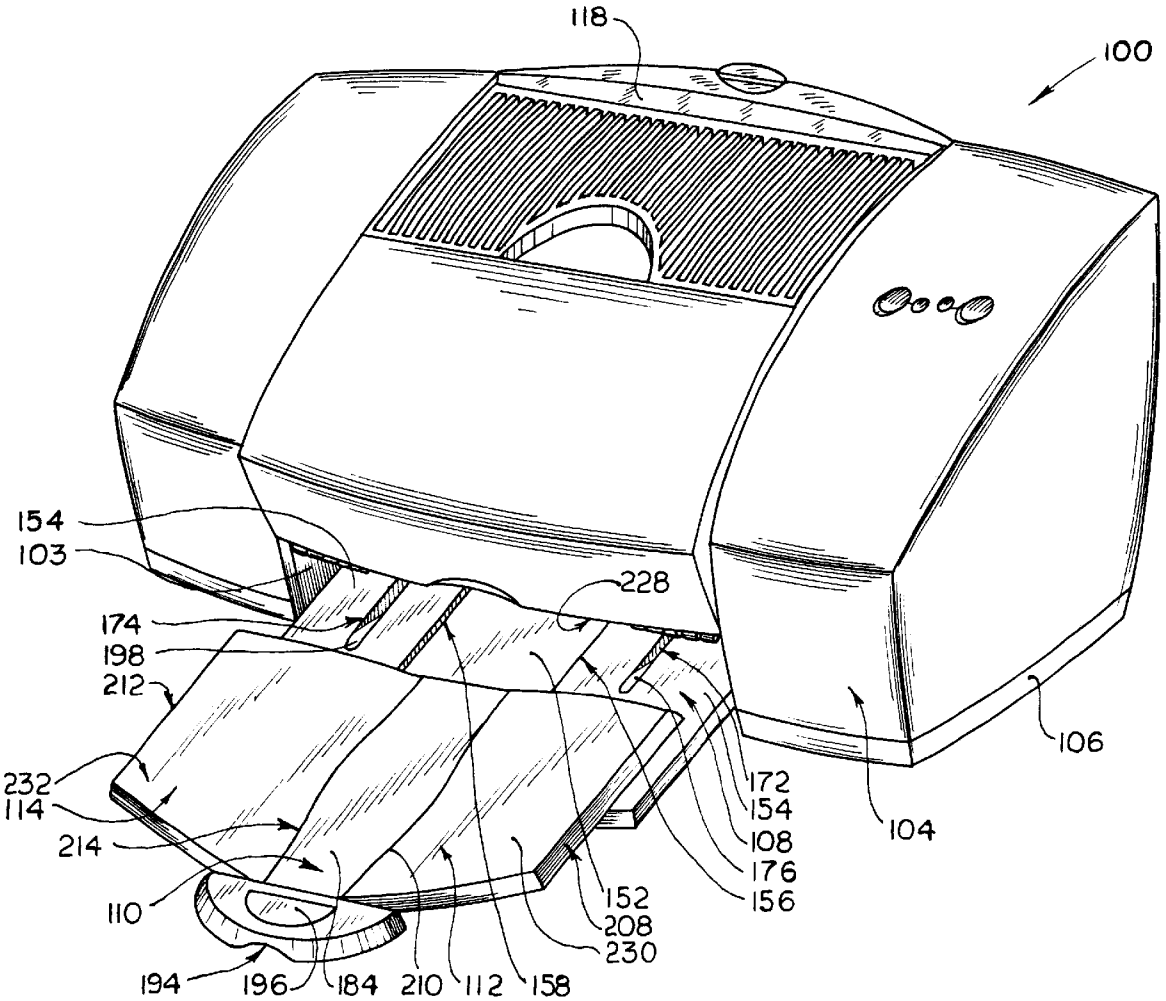
FIG. 2 is a perspective view of the ink jet printer of FIG. 1 with the exit tray shown in the extended position.
Figure 3:
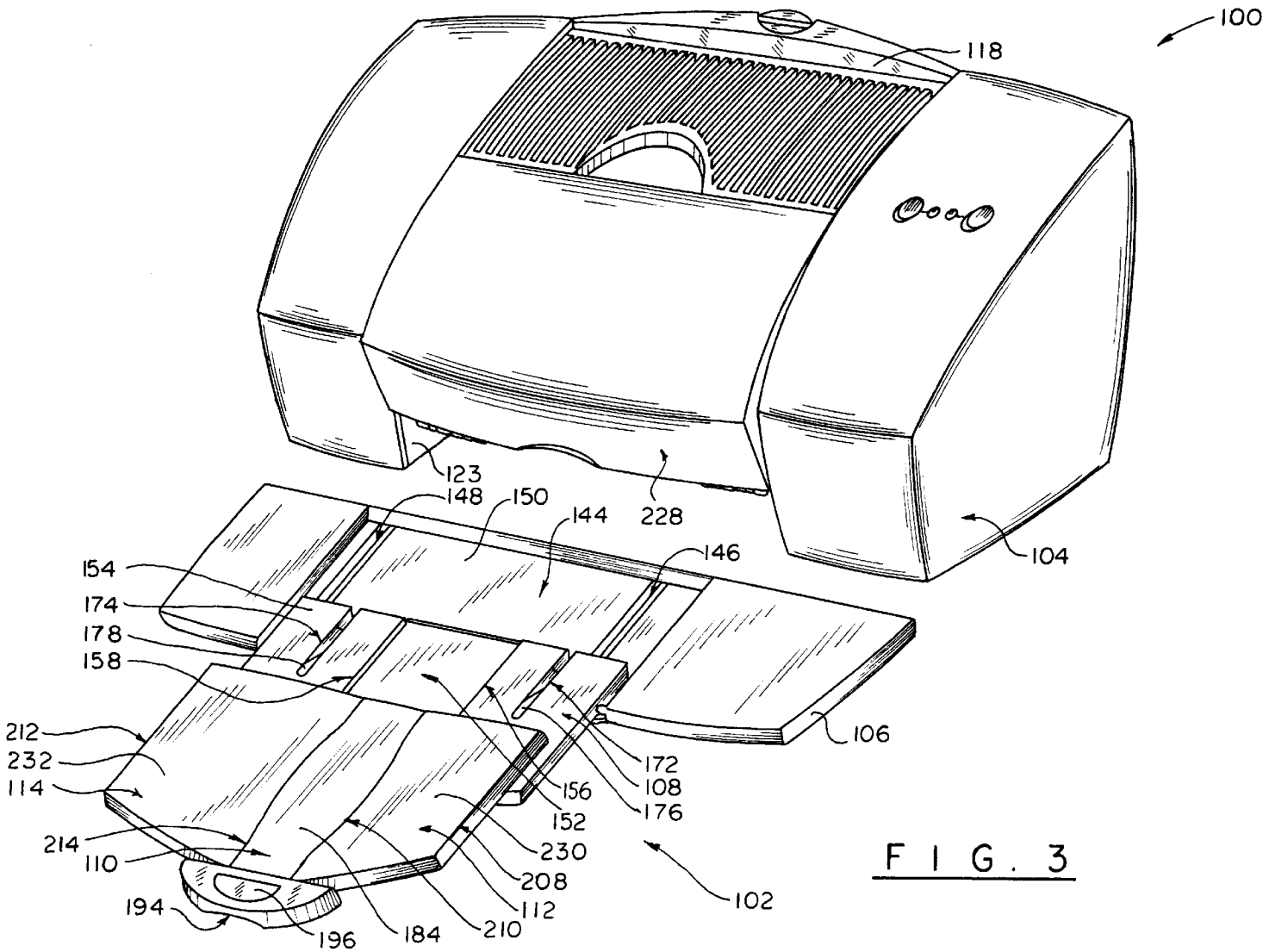
FIG. 3 is a perspective view of the ink jet printer of FIGS. 1 and 2 with the exit tray shown in the extended position and the bottom printer frame detached from the printer housing.

FIGS. 1–3 show an ink jet printer 100 incorporating an exit tray 102 of the present invention. Printer 100 further includes a housing 104 and a bottom frame member 106. As shown in FIG. 1, exit tray 102 is positioned in a retracted position when the printer 100 is not in use. As shown in FIG. 2, exit tray 102 is positioned in an extended position to receive print media, such as one or more sheets of paper, during a printing operation. FIG. 3 shows printer 100 of FIGS. 1 and 2 with bottom frame member 106 detached from housing 104 and exit tray 102 in the extended position.

Exit tray 102 includes a base 108, a base extension 110, a first sheet support member 112, and a second sheet support member 114. With reference to FIGS. 1–11, the structure and function of exit tray 102 will be discussed in greater detail.

Referring now to FIG. 3, base 108 is slideably coupled to bottom frame member 106. Bottom frame member 106 includes two L-shaped guides 146, 148 which slideably engage two corresponding base L-shaped guides (not shown) of base 108 to form a translational joint. Frame guides 146, 148 extend from an upward-facing frame surface 150 and are located in a central, recessed portion 144 of bottom frame member 106. Base 108 slides in a generally horizontal plane relative to bottom frame member 106. Base 108 is slid into frame recessed portion 144 when exit tray 102 is in the retracted position and is extended from frame recessed portion 144 when exit tray 102 is in the extended position. Alternative methods could be used to couple base 108 to bottom frame member 106, such as for example, a roller-track assembly, so long as the coupling means allows base 108 to move along a linear axis in a plane generally parallel to the plane of bottom frame member 106.

Figure 4:
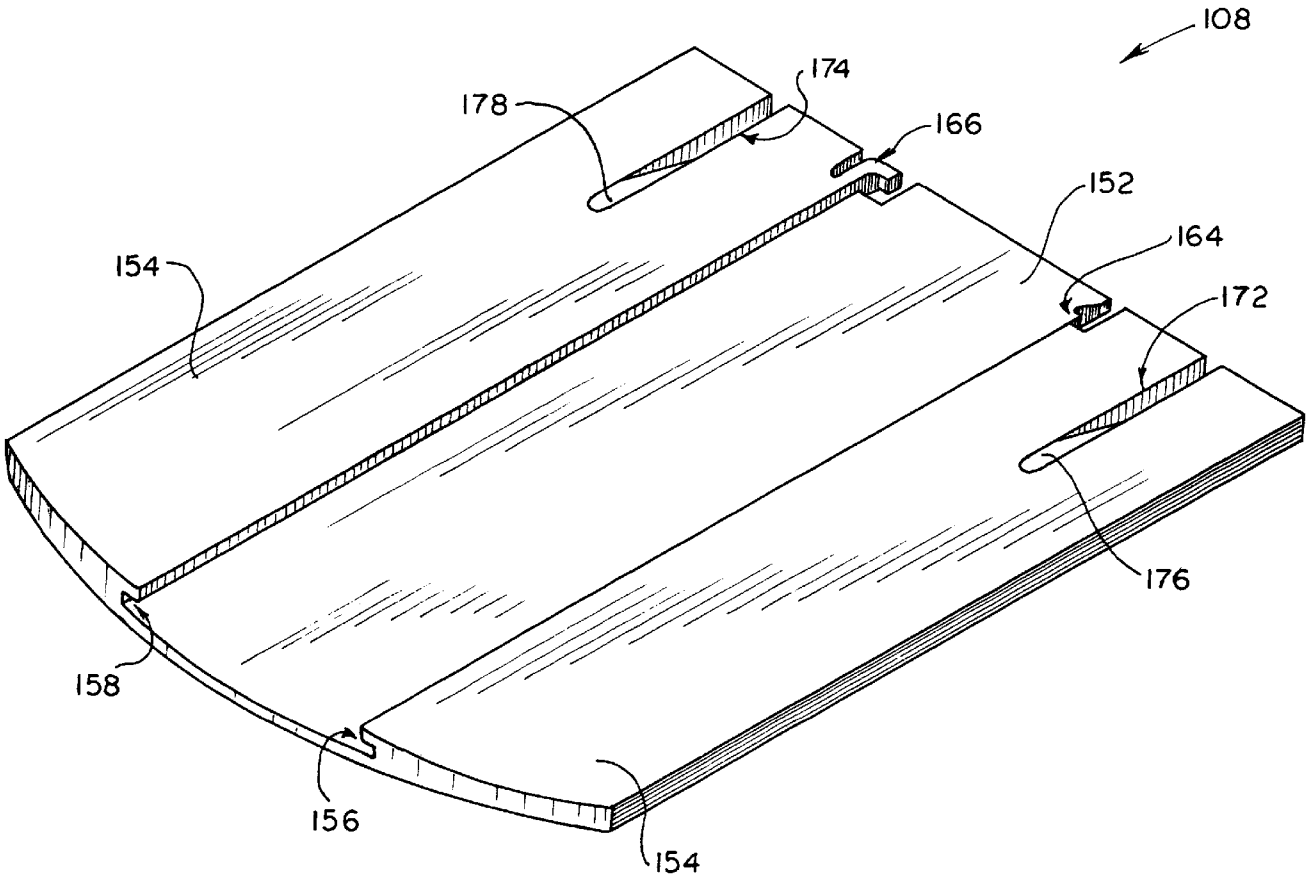
FIG. 4 is a perspective, top view of a base portion of the cam embodiment of the exit tray.
Figure 5:
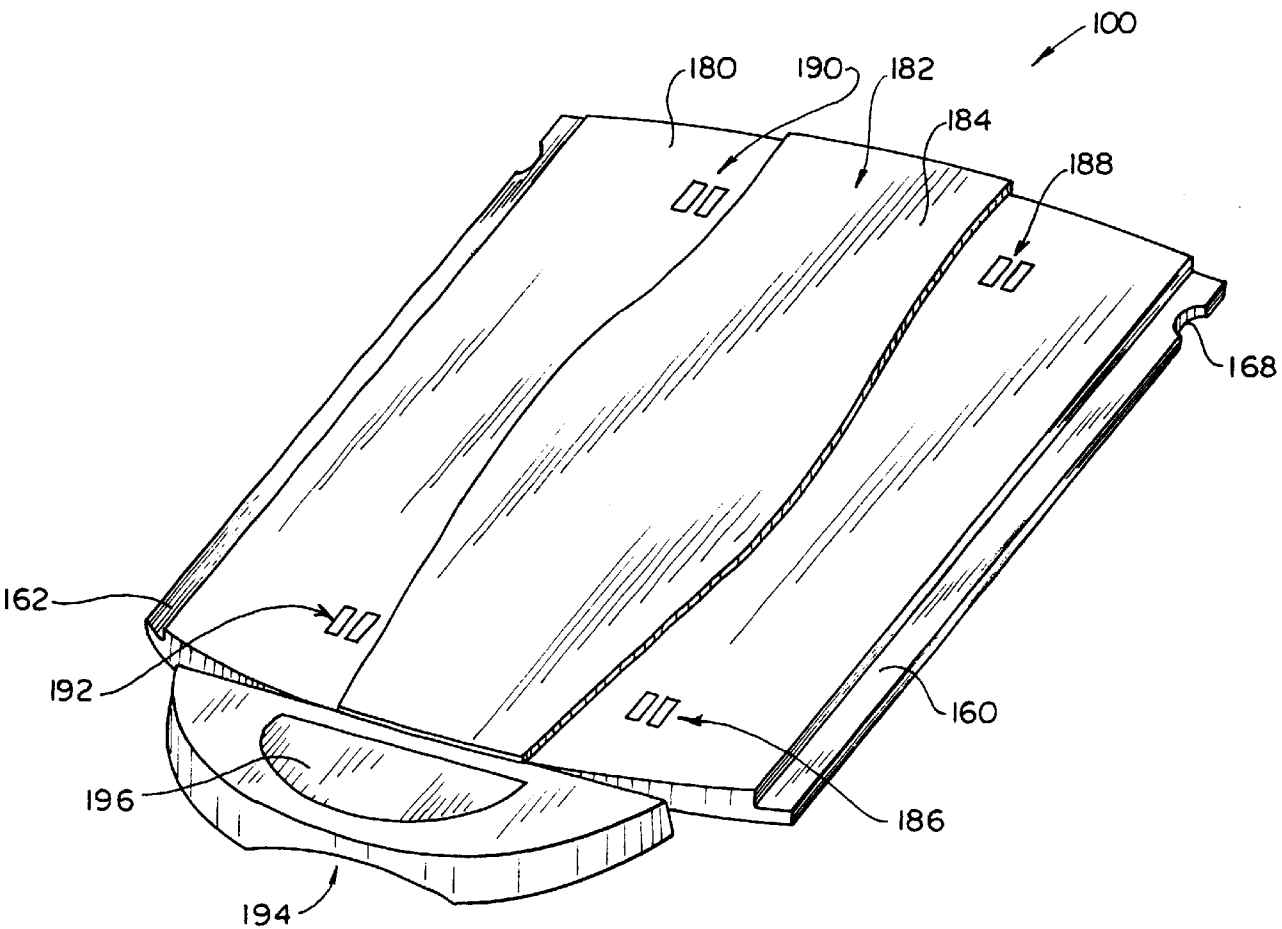
FIG. 5 is a perspective, top view of a base extension portion of the cam embodiment of the exit tray.

As shown in FIG. 4, base 108 further includes two L-shaped guide channels 156, 158 which slideably receive corresponding L-shaped guides 160, 162 of base extension 110 (see FIG. 5). Base guide channels 156, 158 are located within a transversely centered base recess portion 152 generally below an upper surface 154 of base 108. Base extension 110 is disposed generally within base recess 152 when exit tray 102 is in the retracted position and is extended outwardly from base recess 152 when exit tray 102 is in the extended position. Alternative methods could be used to couple base extension 110 to base 108, such as for example, a roller-track assembly, so long as the coupling means allows base extension 110 to move along a linear axis in a plane substantially parallel to the plane of base 108.

Base 108 further includes in base recess portion 152 two detent members 164, 166 to impede the initial extension of base extension 110 relative to base 108. Detent members 164, 166 engage two detent grooves 168, 170 in extension guide channels 160, 162. Detent members 164, 166 are shown as flexible cantilever arms which snap into detent grooves 168, 170 when base extension 110 is disposed within base recess portion 152. Alternative structure could be employed to impede the initial movement of base extension 110 relative to base 108, such as for example, a raised bump portion on base extension 110 which engages a recessed divot portion on base 108.

As shown in FIG. 5, base extension 110 further includes a first pair of slotted apertures 186, a second pair of slotted apertures 188, a third pair of slotted apertures 190 and a fourth pair of slotted apertures 192. The slotted aperture pairs are used to pivotally couple first sheet support member 112 and second sheet support member 114 to base extension 110.

Figure 6:
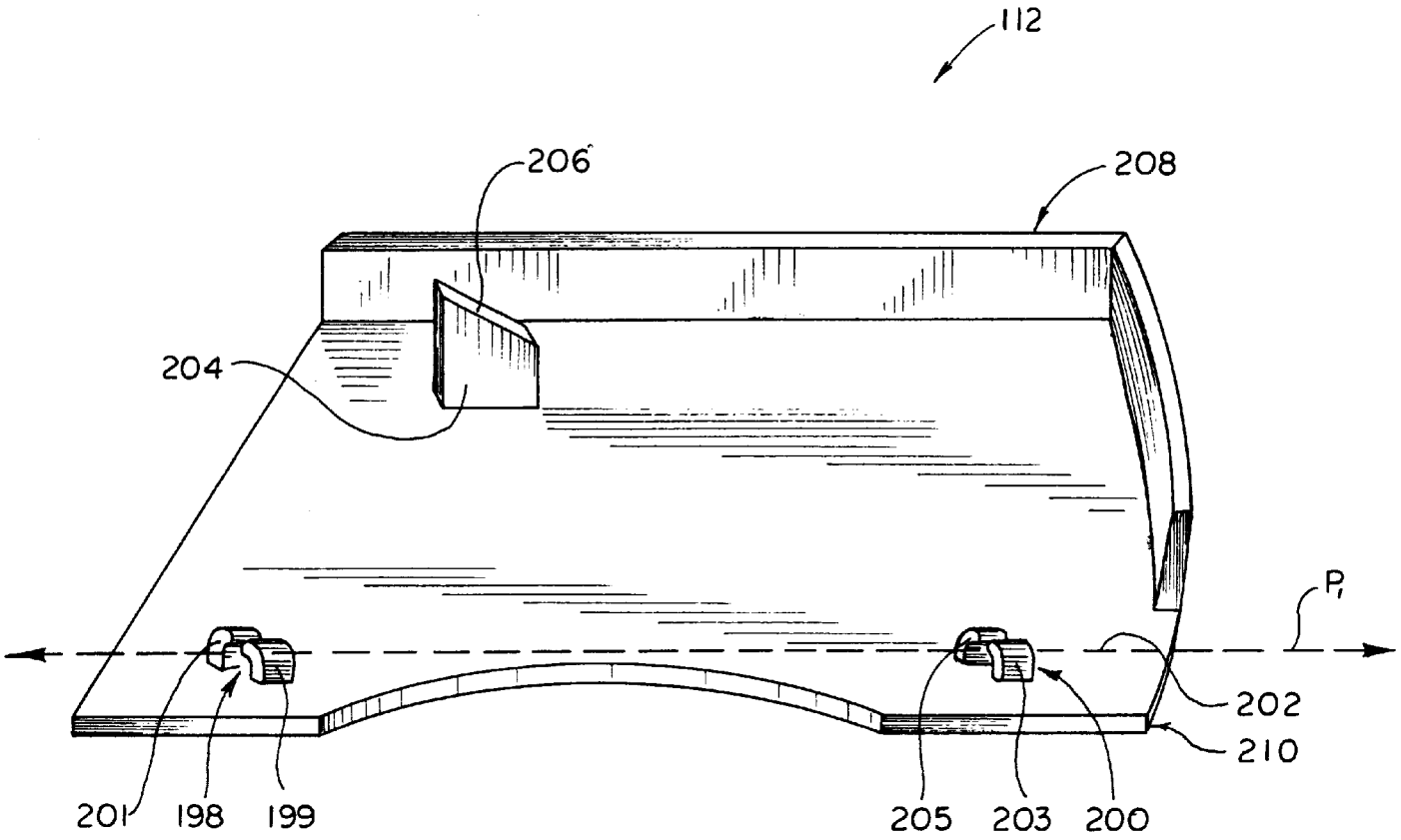
FIG. 6 is a perspective, bottom view of a wing portion of the cam embodiment of the exit tray.

Referring to FIG. 6, first sheet support member 112 includes two clip pairs 198, 200 extending from a surface 202 in a region near a proximal end 210. Clips 198, 200 engage the two clip receiving aperture pairs 186, 188 formed in extension surface 180 of base extension 110 to form a rotational joint. Clip 198 includes a left and a right, partially cylindrical members 199, 201 whose cylindrical axes are aligned to each other. Clip 200 includes a left and a right, partially cylindrical members 203, 205 whose cylindrical axes are aligned to each other. The aligned cylindrical axes of clips 198, 200 define a pivot axis ($P_1$) of first sheet support member 112. Alternative methods could be adopted to pivotally couple first sheet support member 112 to base extension 110, such as for example, a standard hinge.

Second sheet support member 114 has two clips (not shown) which engage the two clip receiving aperture pairs 190, 192 formed in extension surface 180 of base extension 110. The structure and function of the clips of second sheet support member 114 are identical to clips 198, 200 of first sheet support member 112. It should be noted that second sheet support member 114 is generally a mirror image of first sheet support member 112. Therefore, all structure and function disclosed herein for first sheet support member 112 should be understood to be applicable to the structure and function of second sheet support member 114, unless otherwise stated.

When exit tray 102 is in the retracted position (see FIG. 1), the upper surface 230 of first sheet support member 112, the upper surface 232 of second sheet support member 114 and the upper surface 184 of a raised, central portion 182 of base extension 110 are generally co-planer. When exit tray 102 is in the extended position (see FIG. 2), a distal end 208 of first sheet support member 112 and a distal end 212 of second sheet support member 114 are raised upward relative to extension surface 184 and the proximal ends 210, 214 of first and second sheet support members 112, 114, respectively. The proximal ends 210, 214 of sheet support members 112, 114 are pivotally coupled to base extension 110 as described above and remain adjacent to base extension 110.

Referring to FIG. 6, in one embodiment of the present invention, (also referred to as the cam embodiment), the upward movement of distal ends 208, 212 of sheet support members 112, 114 is caused because first sheet support member 112 and second sheet support member 114 each further include a downwardly extending cam member 204 which engages upper surface 154 of base 108. Cam member 204 includes a cam surface 206. When exit tray 102 is in the retracted position, cam members 204 of sheet support members 112,114 are each disposed within a cam recess 172, 174, respectively, located in base 108 (see FIG. 4). Each cam recess 172, 174 has a tapered surface 176, 178, respectively, which extends downwardly from base upper surface 154. When exit tray 102 is in the extended position, cam members 204 of first and second sheet support members 112, 114 are disposed forward of cam recesses 172, 174 and cam member surfaces 206 rest upon base upper surface 154.

Figure 7:
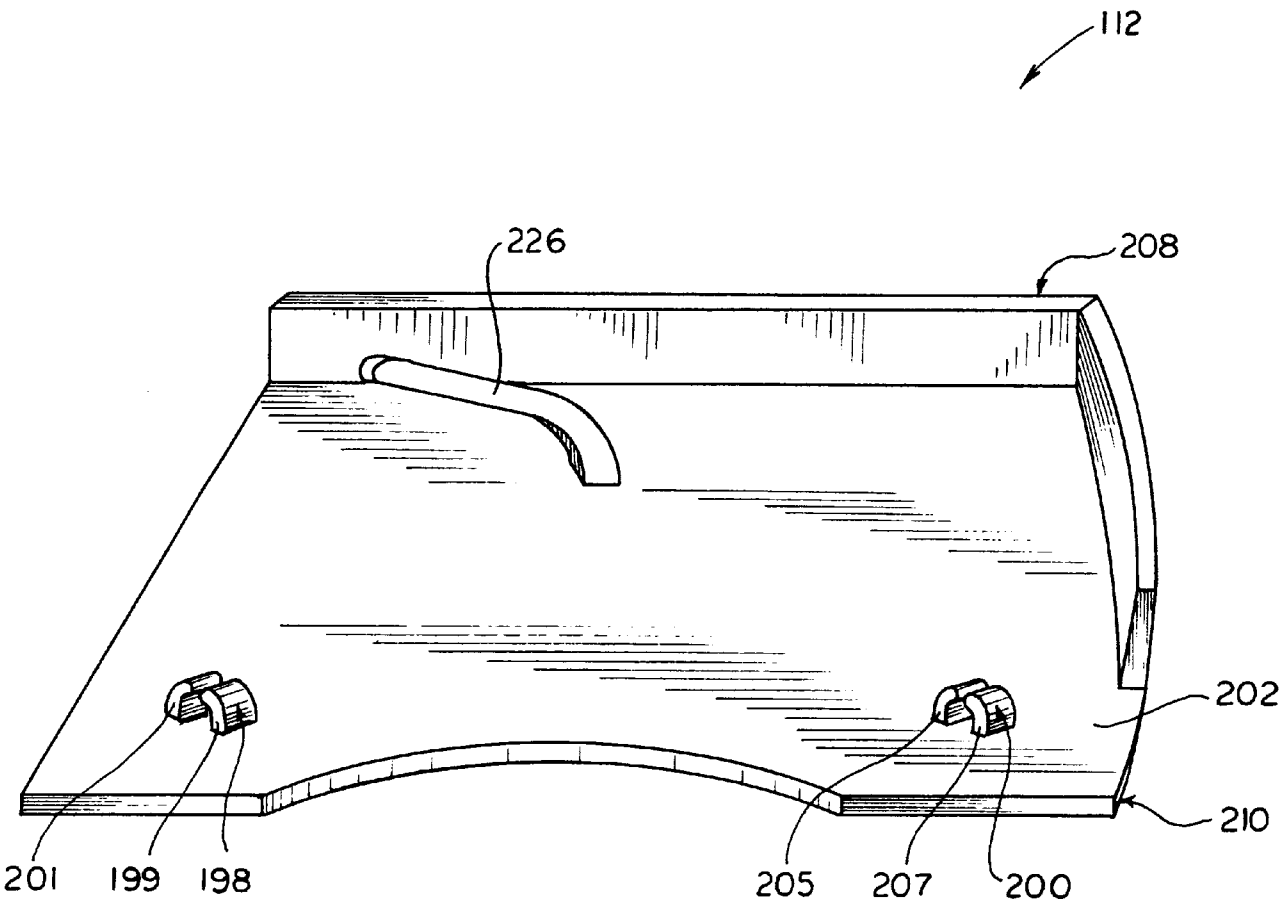
FIG. 7 is a perspective, bottom view of a wing portion of the spring embodiment of the exit tray.

Referring to FIG. 7, in another embodiment of the present invention (also referred to as the spring embodiment), cams 204 are replaced by downwardly extending leaf springs 226. Accordingly, the upward movement of distal ends 208, 212 of first sheet support member 112 and second sheet support member 114 results from an upward force generated by leaf springs 226. When exit tray 102 is in the retracted position, leaf springs 226 are compressed generally against sheet support members 112, 114 and against base upper surface 154. Since leaf springs 226 flex, base cam recesses 172, 174 are not required in base 108. In the retracted position, a downwardly facing surface 228 of frame member 106 applies a downward force on the upper surfaces 230, 232 of first and second sheet support members 112, 114. When exit tray 102 is in the extended position, first and second sheet support members 112, 114 are forward of frame surface 228 and the compression of leaf springs 226 is relieved to thereby lift distal ends 208, 212 of sheet support members 112, 114.

The interaction between the various components in the embodiments of exit tray 102 will now be explained through a discussion of: (a) the relationship between the components in the retracted position, (b) as the components are moved from the retracted position to the extended position, (c) components in the extended position, and (d) as the components are moved from the extended position to the retracted position.

When the cam embodiment of the present invention is in the retracted position (see FIG. 1); base 108, base extension 110, first sheet support member 112 and second sheet support member 114 are generally within the recessed portion 144 of bottom frame member 106 (see FIG. 3). Base extension 110, first sheet support member 112 and second sheet support member 114 are generally co-planar relative to each other and disposed generally above base 108 such that base extension detent grooves 168, 170 (see FIG. 5) engage base detent members 164, 166 (see FIG. 4), and such that cam members 204 are within base cam recesses 172,174.

The cam embodiment of exit tray 102 is moved from the retracted position (see FIG. 1) to the extended position (see FIG. 2) by the application of an outward force by a user on a grip surface 196 of a grip portion 194 of base extension 110. Initially base 108, base extension 110, sheet support members 112,114 all move outward together. This is because detent members 164, 166 (see FIG. 4) have a larger force threshold than the translational joint between base 108 and bottom frame 106. Once base 108 is fully extended, the force threshold of detent members 164, 166 is overcome and base extension 110 slides relatively outward or forward from base 108. As base extension 110 slides outward relative to base 108, cam surface 206 (see FIG. 6) of first sheet support member 112 travels up base cam surface 176 (see FIG. 2) thereby forcing first sheet support member 112 to rotate at clips 198, 200 such that distal end 208 of right sheet support member 112 is raised relative to proximal end 210. The distal end 212 of the second sheet support member 114 is raised relative to proximal end 214 by identical means.

Once the cam embodiment of exit tray 102 is in the extended position (see FIG. 2), cams 204 are forward of base cam recesses 172, 174 and each cam surface 206 of cams 204 of sheet support members 112, 114 rests on base upper surface 154. Base 108 may be held in the extended position, for example, by positioning detent members on bottom frame member 106 to engage base 108.

The cam embodiment of exit tray 102 is moved from the extended position to the retracted position by the application of an inward force by the user on grip 194 to force base extension 110, first sheet support member 112 and second sheet support member 114 to slide inward relative to base 108. As the sheet support members 112, 114 slide inward, cam surfaces 206 of cams 204 slide back down tapered surfaces 176, 178 and into base cam recesses 172, 174 (see FIG. 2). As cam surfaces 206 slide down tapered surfaces 176,178, distal ends 208, 212 of sheet support members 112, 114 rotate downward until they are generally co-planar with base extension 110. Once base extension 110 detent grooves 168, 170 (see FIG. 5) engage base detent members 164, 166 (FIG. 4), base extension 110 is fully retracted and first and second sheet support members 112, 114 are generally co-planar with base extension 110. Base 108 then slides into the bottom frame recess portion 144 of bottom frame member 106, and below downward-facing surface 228 of housing 104.

The spring embodiment of the present invention is substantially identical to the cam embodiment. The most important difference between the spring and cam embodiments is the replacement of cam members 204 (see FIG. 6) with leaf springs 226 (see FIG. 7). When the spring embodiment of exit tray 102 is in the retracted position, downward-facing surface 228 of frame member 106 applies a downward force on the upper surfaces 230, 232 of first and second sheet support members 112, 114, thereby maintaining leaf springs 226 in a compressed state.

In the spring embodiment, as exit tray 102 is moved from the retracted position toward the extended position, sheet support member upper surfaces 230, 232 begin to clear frame surface 228 and the distal ends 208, 212 of first and second sheet support members 112, 114 rotate upward due to the upward force generated as leaf springs 226 are relieved from their compressed state.

As exit tray 102 is moved from the extended position to the retracted position, a downward force is applied to the upper surfaces 230,232 of first and second sheet support members 112, 114 so that upper surfaces 230, 232 pass beneath frame surface 228. This downward force can be achieved manually, for example, by the user applying the downward force. The downward force can also be applied by frame surface 228 by selecting a shape of support members 112, 114 or frame surface 228 such that contact of the upper surfaces 230,232 with frame surface 228 occurs progressively from proximal ends 210, 214 to distal ends 208, 212 of sheet support members 112, 114 as exit tray 102 is moved toward the retracted position. It is within the scope of the present invention to have shallow recesses in base 108, generally similar to cam recesses 172, 174 to accept leaf springs 226 to reduce the downward force to be applied to upper surfaces 230, 232 when exit tray 102 is moved from the extended position to the retracted position.

Figure 8:
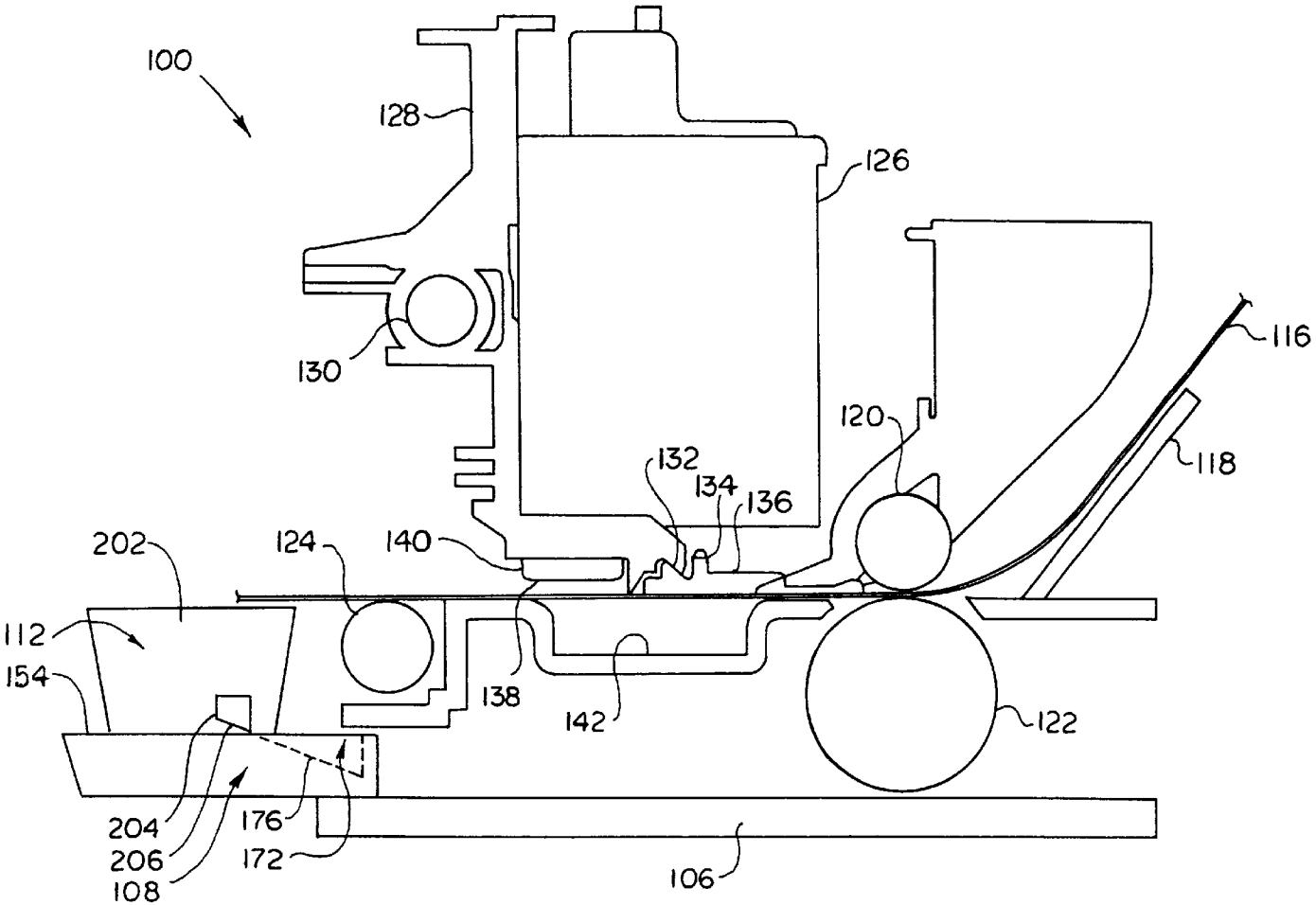
FIG. 8 is a diagrammatic side view of an ink jet printer showing a sheet of media being fed through a printing zone and onto the cam embodiment of the exit tray.
Figure 9:
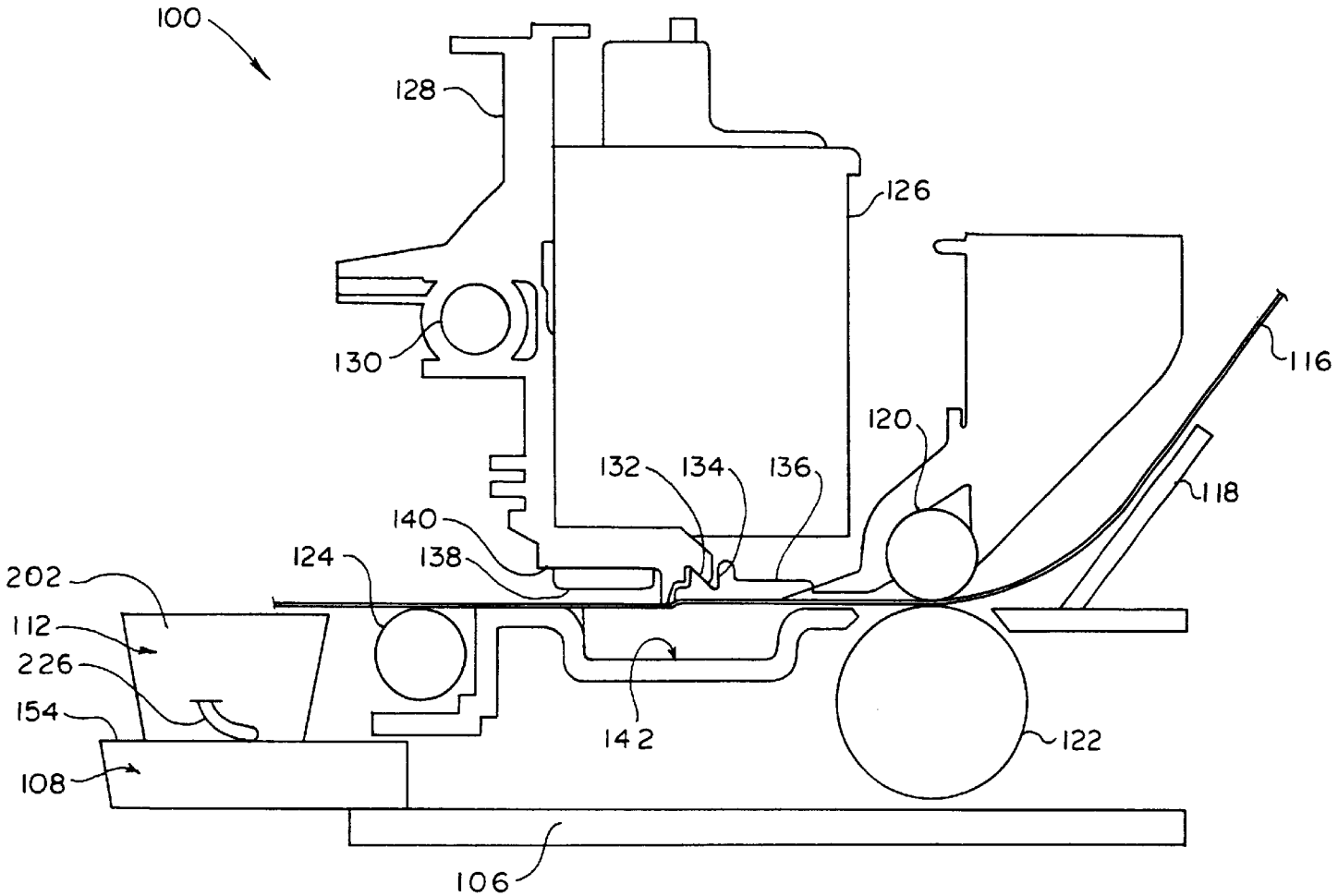
FIG. 9 is a diagrammatic side view of an ink jet printer showing a sheet of media being fed through a printing zone and onto the spring embodiment of the exit tray.

FIG. 8 shows a diagrammatic side view of the operation of ink jet printer 100 with the cam embodiment of exit tray 102. FIG. 9 shows a diagrammatic side view of the operation of ink jet printer 100 with the spring embodiment of exit tray 102. Structural components common to FIGS. 8 and 9 are referred by corresponding reference numerals. Unless otherwise indicated, the discussion that follows applies to both FIGS. 8 and 9.

A sheet of media 116 is transported from an input tray 118 to exit tray 102 by a series of rollers 120, 122, and 124. As media 116 is being transported, it passes beneath a printhead assembly including a cartridge 126 and a carrier 128. The cartridge 126 is removably secured to carrier 128 by a spring-loaded latch (not shown). Carrier 128 is reciprocated back and forth along a guide rod 130 by a drive belt (not shown). The drive belt is driven by a motor that is controlled by an electronic control means. The bottom of carrier 128 contains a foot 132 which rides in a groove 134 of guide rail 136. Both guide rail 136 and guide rod 130 are secured to the side frames (not shown) of printer 100. A nozzle plate 138 on the bottom of a downwardly extending portion 140 of cartridge 126 contains an array of nozzles (not shown) for ejecting ink droplets in a downward direction, toward media 116. A trough 142 is provided to collect waste ink droplets.

As media 116 passes beneath nozzle plate 138, nozzle plate 138 along with the rest of the printhead assembly is reciprocated back and forth along guide rod 130. Ink is ejected from the nozzles in nozzle plate 138 at prescribed transverse locations, to form an image on media 116. The transverse cross-section of media 116 is generally linear while it is being carried from input tray 118 to exit tray 102.

Figure 10:
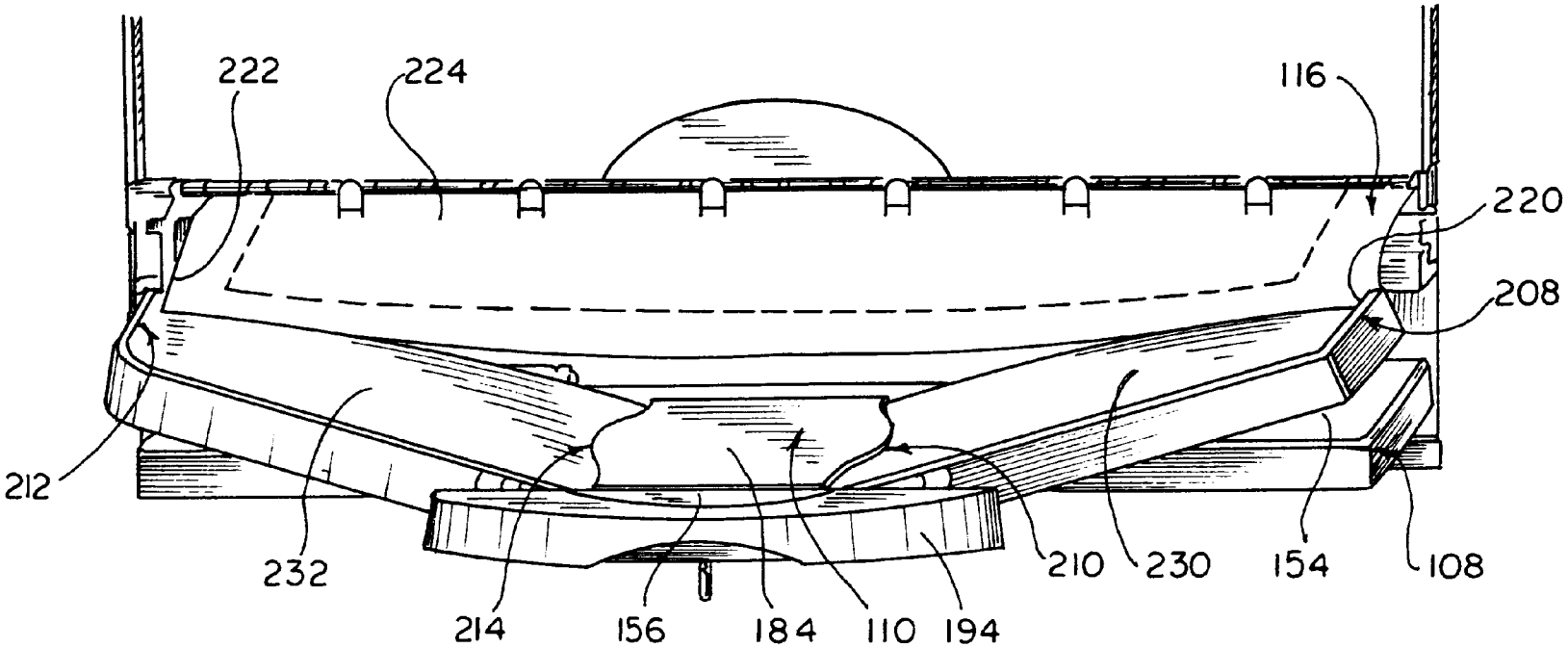
FIG. 10 is a front elevation view of the exit tray of the invention during a normal print operation.

FIG. 10 shows exit tray 102 in the extended position receiving a sheet of media 116 exiting printer 100. As media 116 begins to exit printer 100, the media bends downwardly until media 116 is supported at its right edge 220 by a region of surface 230 near distal end 208 of first sheet support member 112 and at its left edge 222 by a region of surface 232 near distal end 212 of second sheet support member 114. As long as the trailing end of media 116 is supported within printer 100, and supported at right and left edges 220, 222 by sheet support members 112, 114, media 116 is held generally flat (planar), but with a slight undulation which increases in magnitude from the trailing end of media 116 to the front end of media 116. Once the trailing end of media 116 is released by printer 100, media 116 assumes a generally concave shape along its transverse direction due to the support of right and left edges 220, 222 and the downward force of gravity on the unsupported regions of media 116. The central portion of media 116 rests on upper surface 184 of base extension 110. The concave, transverse cross-section provides increased stiffness to media 116 along its longitudinal axis. Because of the increased stiffness, media 116 can have a longer longitudinal extent than the extent of exit tray 102 in the extended position and still maintain a linear longitudinal cross-section.

Since the printed media is retained in exit tray 102 in a concave shape, use of exit tray 102 allows a longer ink drying time for a printed sheet then would be possible in a traditional flat exit tray. Because ink is not usually printed immediately adjacent to left and right transverse edges 220, 222 of media 116, the printed portion 224 of media 116 resting in exit tray 102 is significantly lower than the non-printed edges 220, 222. Thus, a subsequent sheet of media is carried at its transverse edges by first and second sheet support members 112, 114 above the printed portion 224 of media 116. Until released by printer 100, the transverse cross-section of the subsequent sheet of media is generally linear and, therefore, printed region 224 of media 116 is not contacted by the subsequent sheet until the subsequent sheet is released by printer 100, thereby permitting an extended drying time for the printed portion 224 of media 116.

The exemplifications set forth herein illustrate preferred embodiments of the invention and should not be construed as limiting the scope of the invention. Although the invention has been described in detail with reference to certain preferred embodiments, those skilled in the art will recognize that variations and modifications exist within the scope and spirit of the present invention as described and defined in the following claims.

What is claimed is:

1. A media tray for receiving a sheet of media transported thereto from an imaging apparatus, said media tray comprising:

a base having an inclined region;

a media support assembly movably coupled to said base, said media support assembly including a support unit for supporting at least a portion of said sheet of media, said support unit including at least one downwardly extending cam member having at least one cam surface for engaging said inclined region of said base, wherein as said media support assembly is moved in a first direction in relation to said base, said at least one cam surface engages said inclined region of said base to force an outer portion of said support unit to move upwardly in relation to said base.

2. The media tray of claim 1, wherein said base is slideably coupled to said imaging apparatus, said base having an upper surface which includes said inclined region.

3. The media tray of claim 2, wherein said media support assembly further comprises a base extension positioned above said base and slideably coupled to said base, said base extension having a first side region and a second side region.

4. The media tray of claim 3, wherein said media support assembly further comprises a first sheet support member pivotally coupled to said first side region of said base extension, said first sheet support member including a downwardly extending first cam member having a first cam surface for engaging said inclined region of said base; and, a second sheet support member pivotally coupled to said second side region of said base extension, said second sheet support member including a downwardly extending second cam member having a second cam surface for engaging said inclined region of said base, wherein as said base extension is slid outwardly from said base, said first cam surface and said second cam surface engage said inclined region of said base to force each of said first sheet support member and said second sheet support member to pivot upwardly and away from said base.

5. The media tray of claim 4, wherein said first sheet support member is pivotally coupled to said first side region of said base extension by a first clip mechanism, and wherein said second sheet support member is pivotally coupled to said second side region of said base extension by a second clip mechanism.

6. A media tray for receiving a sheet of media transported thereto from an imaging apparatus, said media tray comprising:

a base having an upper surface;

a media support assembly movably coupled to said base, said media support assembly including a support unit for supporting at least a portion of said sheet of media, said support unit including at least one downwardly extending spring mechanism for engaging said upper surface of said base, wherein as said media support assembly is moved in a first direction in relation to said base, said at least one spring mechanism engages said upper surface of said base to force an outer portion of said support unit to move upwardly in relation to said base.

7. The media tray of claim 6, wherein said base is slideably coupled to said imaging apparatus.

8. The media tray of claim 7, wherein said media support assembly further comprises a base extension positioned above said base and slideably coupled to said base, said base extension having a first side region and a second side region.

9. The media tray of claim 8, wherein said media support assembly further comprises a first sheet support member pivotally coupled to said first side region of said base extension, said first sheet support member including a downwardly extending first spring mechanism for engaging said upper surface of said base; and, a second sheet support member pivotally coupled to said second side region of said base extension, said second sheet support member including a downwardly extending second spring mechanism for engaging said upper surface of said base, wherein as said base extension is slid outwardly from said base, said first spring mechanism and said second spring mechanism engage said upper surface of said base to force each of said first sheet support member and said second sheet support member to pivot upwardly and away from said base.

10. The media tray of claim 9, wherein said first sheet support member is pivotally coupled to said first side region of said base extension by a first clip mechanism, and wherein said second sheet support member is pivotally coupled to said second side region of said base extension by a second clip mechanism.

11. An imaging apparatus, comprising:

media feeding means for transporting a sheet of media;

imaging means for forming an image on said sheet of media transported by said media feed means; and a media receiving device for receiving said sheet having an image from said media feed means, said media receiving device including:

a base having an inclined region; and a media support assembly movably coupled to said base, said media support assembly including a support unit for supporting at least a portion of said sheet of media, said support unit including at least one downwardly extending cam member having at least one cam surface for engaging said inclined region of said base, wherein as said media support assembly is moved in a first direction in relation to said base, said at least one cam surface engages said inclined region of said base to force an outer portion of said support unit to move upwardly in relation to said base.

12. The imaging apparatus of claim 11, wherein said base is slideably coupled to a frame of said imaging apparatus, said base having an upper surface which includes said inclined region.

13. The imaging apparatus of claim 12, wherein said media support assembly further comprises a base extension positioned above said base and slideably coupled to said base, said base extension having a first side region and a second side region.

14. The imaging apparatus of claim 13, wherein said media support assembly further comprises a first sheet support member pivotally coupled to said first side region of said base extension, said first sheet support member including a downwardly extending first cam member having a first cam surface for engaging said inclined region of said base; and a second sheet support member pivotally coupled to said second side region of said base extension, said second sheet support member including a downwardly extending second cam member having a second cam surface for engaging said inclined region of said base, wherein as said base extension is slid outwardly from said base, said first cam surface and said second cam surface engage said inclined region of said base to force each of said first sheet support member and said second sheet support member to pivot upwardly and away from said base.

15. The imaging apparatus of claim 14, wherein said first sheet support member is pivotally coupled to said first side region of said base extension by a first clip mechanism, and wherein said second sheet support member is pivotally coupled to said second side region of said base extension by a second clip mechanism.

16. An imaging apparatus, comprising:

media feeding means for transporting a sheet of media;

imaging means for forming an image on said sheet of media transported by said media feed means; and a media receiving device for receiving said sheet having an image from said media feed means, said media receiving device including:

a base having an upper surface; and a media support assembly movably coupled to said base, said media support assembly including a support unit for supporting at least a portion of said sheet of media, said support unit including at least one downwardly extending spring mechanism for engaging said upper surface of said base, wherein as said media support assembly is moved in a first direction in relation to said base, said at least one spring mechanism engages said upper surface of said base to force an outer portion of said support unit to move upwardly in relation to said base.

17. The imaging apparatus of claim 16, wherein said base is slideably coupled to a frame of said imaging apparatus.

18. The imaging apparatus of claim 17, wherein said media support assembly further comprises a base extension positioned above said base and slideably coupled to said base, said base extension having a first side region and a second side region.

19. The imaging apparatus of claim 18, wherein said media support assembly further comprises a first sheet support member pivotally coupled to said first side region of said base extension, said first sheet support member including a downwardly extending first spring mechanism for engaging said upper surface of said base; and, a second sheet support member pivotally coupled to said second side region of said base extension, said second sheet support member including a downwardly extending second spring mechanism for engaging said upper surface of said base, wherein as said base extension is slid outwardly from said base, said first spring mechanism and said second spring mechanism engage said upper surface of said base to force each of said first sheet support member and said second sheet support member to pivot upwardly and away from said base.

20. The imaging apparatus of claim 19, wherein said first sheet support member is pivotally coupled to said first side region of said base extension by a first clip mechanism, and wherein said second sheet support member is pivotally coupled to said second side region of said base extension by a second clip mechanism.

21. A retractable media tray for use in conjunction with an imaging apparatus for receiving a sheet of media from said imaging apparatus, comprising:

a base slideably coupled to said imaging apparatus, said base having an upper surface;

a base extension positioned above said base and slideably coupled to said base, said base extension having a first side region and a second side region;

a first sheet support member pivotally coupled to said first side region of said base extension, said first sheet support member including a downwardly extending first spring mechanism for engaging said upper surface of said base; and a second sheet support member pivotally coupled to said second side region of said base extension, said second sheet support member including a downwardly extending second spring mechanism for engaging said upper surface of said base, wherein as said base extension is slid outwardly from said base, said first spring mechanism and said second spring mechanism assume a non-compressed state to force each of said first sheet support member and said second sheet support member to pivot upwardly and away from said base.

* * * * *